US007837571B2

(12) United States Patent
Romagnoli et al.

(10) Patent No.: US 7,837,571 B2
(45) Date of Patent: Nov. 23, 2010

(54) DEVICE FOR DISPLAYING INFORMATION, IN PARTICULAR FOR BOWLING ALLEYS

(75) Inventors: Luca Romagnoli, S. Agata Bolognese (IT); Alberto Vitali, Casalecchio Di Reno (IT)

(73) Assignee: QubicaAMF Europe S.p.A, Bologna (IT)

( * ) Notice: Subject to any disclaimer, the term of this patent is extended or adjusted under 35 U.S.C. 154(b) by 2370 days.

(21) Appl. No.: 10/392,009

(22) Filed: Mar. 19, 2003

(65) Prior Publication Data

US 2003/0181250 A1 Sep. 25, 2003

(30) Foreign Application Priority Data

Mar. 20, 2002 (WO) ..... PCT/IT02/00174

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 473/67; 473/53; 473/58; 473/70; 340/323 B; 340/323 R; 700/90; 700/91; 248/200

(58) Field of Classification Search ..... 473/55, 473/70; 434/249

See application file for complete search history.

(56) References Cited

U.S. PATENT DOCUMENTS

| | | | | |
|---|---|---|---|---|
| 4,937,772 | A * | 6/1990 | Chavez et al. | 473/55 |
| 5,255,185 | A * | 10/1993 | Mowers et al. | 340/323 R |
| 5,618,238 | A * | 4/1997 | Kruse et al. | 473/70 |
| 5,709,607 | A * | 1/1998 | Mowers et al. | 473/58 |

FOREIGN PATENT DOCUMENTS

| | | |
|---|---|---|
| EP | 0 548 055 A2 | 6/1993 |

* cited by examiner

*Primary Examiner*—Dmitry Suhol
*Assistant Examiner*—Paul A. D'Agostino
(74) *Attorney, Agent, or Firm*—Andrew M. Calderon; Roberts Mlotkowski Safran & Cole, P.C.

(57) ABSTRACT

A device for displaying information, in particular for bowling alleys, comprises first detector mechanism, to detect an arrangement pattern of one or more bowling pins and generate a corresponding main detection signal, incorporating an identification code, and a control unit, connected to the first detector mechanism, for receiving the main detection signal at input; the control unit is set up in such a way that at output it transmits at least one animation according to the identification code incorporated in the main detection signal. The device is also equipped with a display element, connected to the control unit, for receiving the animation at input and allowing it to be displayed.

20 Claims, 4 Drawing Sheets

DEVICE FOR DISPLAYING INFORMATION, IN PARTICULAR FOR BOWLING ALLEYS

TECHNICAL FIELD

The present invention relates to a device for displaying information, in particular for bowling alleys.

BACKGROUND ART

As is known, a bowling alley lane basically consists of a bowling surface which extends longitudinally, on which a preset number of bowling pins (normally 10) is set out. The player must knock the pins down by throwing a ball at them.

If, with a single throw, the player knocks down all of the pins, it is called a "strike". In contrast, if after the first throw one or more pins are still standing, the player is entitled to a second throw, to try to knock down the remaining pins.

Upon finishing a turn, which consists of a single throw in the case of a "strike", or two throws if no strike is achieved, the player is assigned a score, according to the number of pins knocked down.

For this purpose there are suitable detector means, able to count the number of pins knocked down and to calculate the relative score, even according to the number of throws taken.

There are display means connected to the detector means. The display means normally consist of screens or monitors, which make available, in real time, all data relative to the current game and the various players taking part (players' names, scores for each turn, total scores, etc.).

In order to improve the quality of each player's game and to increase the probability that each, with the two throws available to them, will knock down all of the pins in the lane, the above-mentioned display means are also set up in such a way that they provide appropriate suggestions.

The indications provided by the device are particularly helpful, above all if, after the first throw, not all of the pins are knocked down. Depending on the arrangement pattern of the pins still standing, the player must select the trajectory to be followed by the ball for the second throw with great accuracy.

In particular, the player must be able to throw the ball in such a way that all of the pins still standing are knocked down, if necessary so that some pins knock down others as they fall, with a kind of "domino" effect, allowing all of the pins to be knocked down.

To provide players with appropriate suggestions, there are devices currently available which indicate the point at which the ball must hit the pins still standing in order to knock all of them down, but no further information is supplied regarding the trajectory of the ball or the effects of impact with the pins.

In other words, the devices currently marketed can provide a static image on the display means, showing only the ideal point of contact between the ball and one or more of the standing pins, without the player knowing how the ball must reach that position and what effects the suggested throw will have on each pin.

The disadvantages of the devices described above are, therefore, obvious.

The suggestions for players supplied by such devices are imprecise, since only a single static image is displayed, indicating the ideal point of contact between the ball and the pins still standing.

In particular, since such a static image does not provide complete indications for a correct throw and does not provide the player with information detailed enough to allow an understanding of the effects of such a throw, the player cannot fully comprehend the consequences of the throw he or she is about to take and, therefore, cannot improve his or her technique.

DISCLOSURE OF THE INVENTION

The aim of the present invention is, therefore, to overcome the above-mentioned disadvantages.

In particular, the aim of the present invention is to provide a device for displaying information, in particular for bowling alleys, which makes complete and precise indications available to the player regarding the stages of the game about to be played.

Another aim of the present invention is to make available a device which, by displaying animations, allows the player to fully comprehend the effects of the throw to be performed and, as a result, to improve his or her technique.

These and other aims are achieved by a device for displaying information, in particular for bowling alleys, as described in the claims herein.

BRIEF DESCRIPTION OF THE DRAWINGS

Further features and advantages are more clearly illustrated in the detailed description which follows, with reference to the accompanying drawings, which illustrate a preferred embodiment of a device for displaying information, in particular for bowling alleys, without limiting the scope of its application, and in which.

DETAILED DESCRIPTION OF THE PREFERRED EMBODIMENTS OF THE INVENTION

The device for displaying information, in particular for bowling alleys, is indicated as a whole by the numeral 1 in the accompanying drawings.

Firstly, it is important to emphasise the meaning of some terms in this context.

The expression "static image" refers to a single, fixed image, without any animation or processing designed to dynamically represent changes or movements. In other words, it is an image similar to a photograph, preferably digital and showing one or more objects or elements.

Vice versa, the expression "animation" refers to any type of representation obtained, for example, using a succession of static images which, when viewed one after another, in a preset sequence and at a given speed, gives the viewer the optical impression of movement or, generally, a dynamic change in the situation represented with the passage of time. A second example of an "animation" may be obtained starting with an initial, static image, in which, according to precise temporal progressions, some portions are changed, so that what the viewer sees is a situation which changes dynamically (typically, a moving object which changes its position with the passage of time) from one moment to the next.

That being said, reference is made to the accompanying drawings for a detailed description of the device in accordance with the present invention.

Figure 1:
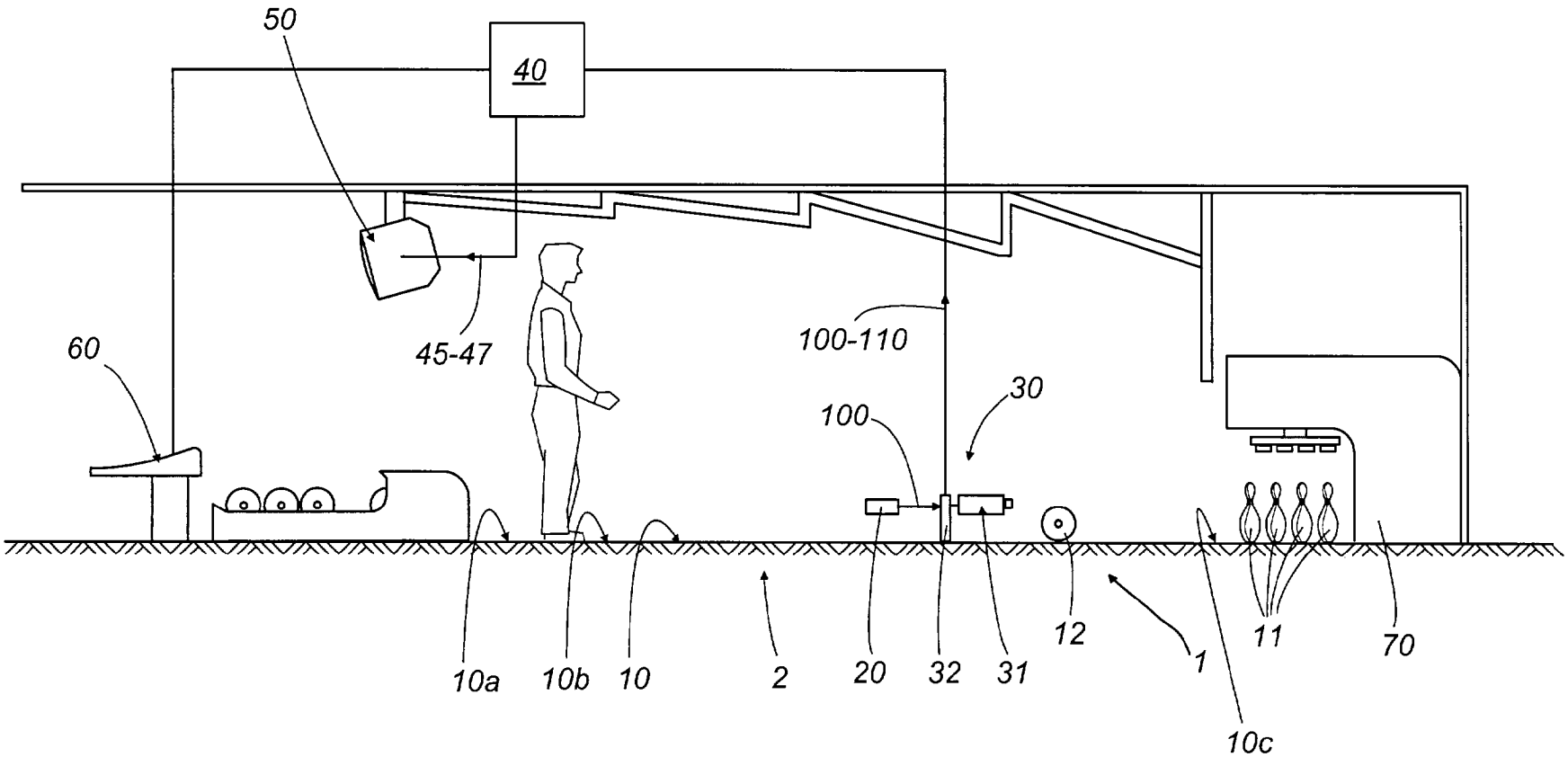
FIG. 1 is a schematic view of a device in accordance with the present invention attached to an apparatus for tenpin bowling.

FIG. 1 in particular illustrates the device 1 attached to a generic tenpin bowling apparatus 2.

The apparatus 2 has at least one lane 10, with a bowling surface 10*a* which extends mainly longitudinally, on which a ball 12 is thrown and rolls in order to knock down a preset number of bowling pins 11.

In particular, the bowling surface 10*a* has a first end 10*b*, where the ball 12 is thrown, and a second end 10*c*, opposite the first end 10*b*, where the pins 11 are positioned and towards which the ball 12 is thrown in order to knock down the pins 11.

Close to the second end 10*c* there is a collection device 70, which collects and sets out the pins 11 on the bowling surface 10*a*.The device 70 is activated at the end of each player's turn, when the pins 11 must be collected and distributed according to a preset starting pattern, so that the next player can begin his or her turn.

To aid the players as they play, as indicated above, the device 1 for displaying information can be connected to the apparatus 2.

The device 1 normally updates and displays all of the information necessary for the game (players' names, scores for each turn, total scores, etc.), according to the results obtained by the players.

Figure 4:
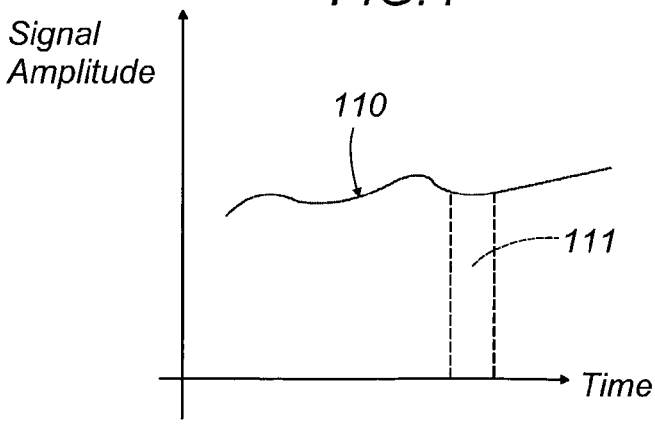
FIG. 4 shows the logic structure of a signal used in the device illustrated in FIG. 1.

For this purpose, the device 1 has first detector means 30, designed to detect the arrangement pattern of the pins 11 on the bowling surface 10*a*. Depending on this arrangement pattern, the means 30 generate a main detection signal 110, which incorporates an identification code 111 (FIG. 4), indicating the distribution of the pins 11 and, in particular the position of those pins 11 which, after a first throw of the ball 12 by a player, are still standing.

In a preferred embodiment, the detector means 30 may consist of a camera 31, with an angle of vision which covers all of the pins 11 of at least one lane 10, and an electronic card 32 attached to it. The electronic card 32 is programmed to generate a reading map for the camera 31, to define a matrix of co-ordinates relative to the arrangement pattern of the pins 11. In other words, the electronic card 32 can receive the image, relative to pin 11 distribution, is picked up by the camera 31 and convert it, using a preset algorithm, into digital information, which is made available to other elements of the device 1. This digital information is, basically, the identification code 111 incorporated in the main detection signal 110.

The main detection signal 110, representing the information described above, is received by a control unit 40, connected to the above-mentioned first detector means 30.

According to the arrangement pattern of the pins 11 represented by the identification code 111, the control unit 40 provides one or more items of information regarding the game at output. This information may, for example, relate to the scores for each turn and the total scores. For this purpose the processing unit 40 compares the matrix indicated by the identification code 111 with a programmed matrix, to discover how many pins have been knocked down and, as a result, what score must be assigned to each player.

Another characteristic function of the control unit 40 is the possibility of supplying at output, again according to the data received at input through the identification code 111 incorporated in the main detection signal 110, an animation 45, containing indications about how to throw the ball 12 in order to knock down the pins 11.

In particular, the animation 45 may be an animated representation of the movement of the ball 12, according to a trajectory suggested for throwing in the best possible way, and the consequent movement of the pins 11, which are hit and knocked down by the ball 12.

Hereinafter, the numeral 12*a* denotes the ball in the animations 45, to distinguish it from the ball 12 which is physically available to the player for a throw. Similarly, 11*a* denotes the pins in the animations, to distinguish them from the pins 11 actually present in the lane 10.

The animation 45 basically shows (see, for example, FIG. 3, which is described in more detail below) a ball 12*a* which, following an ideal trajectory, hits one or more of the pins 11*a*, knocking them down and completing the player's turn in the best possible way. It also shows the falling movement of each pin 11*a*, after being hit by the ball 12*a* or by another pin 11*a* as it falls.

The animation 45 may be advantageously used after the player has completed a first throw without a "strike", that is to say, when the player has a second throw available, in order to knock down those pins still standing. In this case, the animation 45 may show the player how to take the second throw, with greater precision than existing systems.

More specifically, the first detector means 30 detect the arrangement pattern of the pins 11 which, following a first throw of the ball 12, are still standing, and communicate it to the control unit 40 by means of the main detection signal 110 and the relative identification code 111. The control unit 40, in turn, according to the content of the main detection signal 110, transmits at output an animation 45, simulating a second, "ideal" throw, in which the ball 12*a* knocks down a's many of the pins 11*a* still standing as possible. In particular, the animation 45 represents the movement of the ball 12*a* towards the pins 11*a* and the falling movement of the various pins 11*a*.

The player should, therefore, reproduce the situation suggested by the device 1, by throwing the ball 12 and knocking down the pins 11.

Conveniently, to better illustrate the suggested throw and its effects to the player, the animation 45 may consist of a first portion and at least a second portion, following the first. The two portions are separated by a static image, showing, for example with one or more arrows, the direction in which the ball 12 must be thrown, the direction in which the pins 11*a* hit fall and, if necessary, in which they hit other pins. The arrows indicate the directions of movement and falling may be accompanied by written messages, which describe the meaning of the arrows.

In further detail, the static image between the first and the second portion can "anticipate" the movements in the second portion, indicating the directions in which the ball 12*a* and the pins 11*a* are going to move, after the initial dynamics contained in the first portion.

Therefore, in light of the dynamics shown in the first portion, this type of static image provides a static preview of the dynamics which are subsequently represented in the second portion.

The effect obtained when the animation 45 is viewed is a sort of short film which, for each impact between the ball 12*a* and one or more pins 11*a*, or an impact between a plurality of pins 11*a*, is automatically stopped, for several moments, on a static image, which shows the movements illustrated in detail.

When a preset interval has elapsed, the film starts up again, showing the player the subsequent developments in the suggested throw.

If the succession of impacts and falls which must be illustrated is particularly complex, the animation 45 may include a plurality of portions. Each portion represents a specific part of the dynamics involved after the suggested throw.

The animation 45 may, therefore, start with an initial portion, followed by a plurality of portions, which follow one another over a period of time, each separated from the portion immediately before it by a static image of the type described above. Each of the static images shows a direction of movement of the ball 12*a* and/or a direction of fall for one or more of the pins 11*a*. More specifically, each static image anticipates, with the arrows and written messages that it contains, the movements represented by the portion preceded by the static image.

Figure 3:
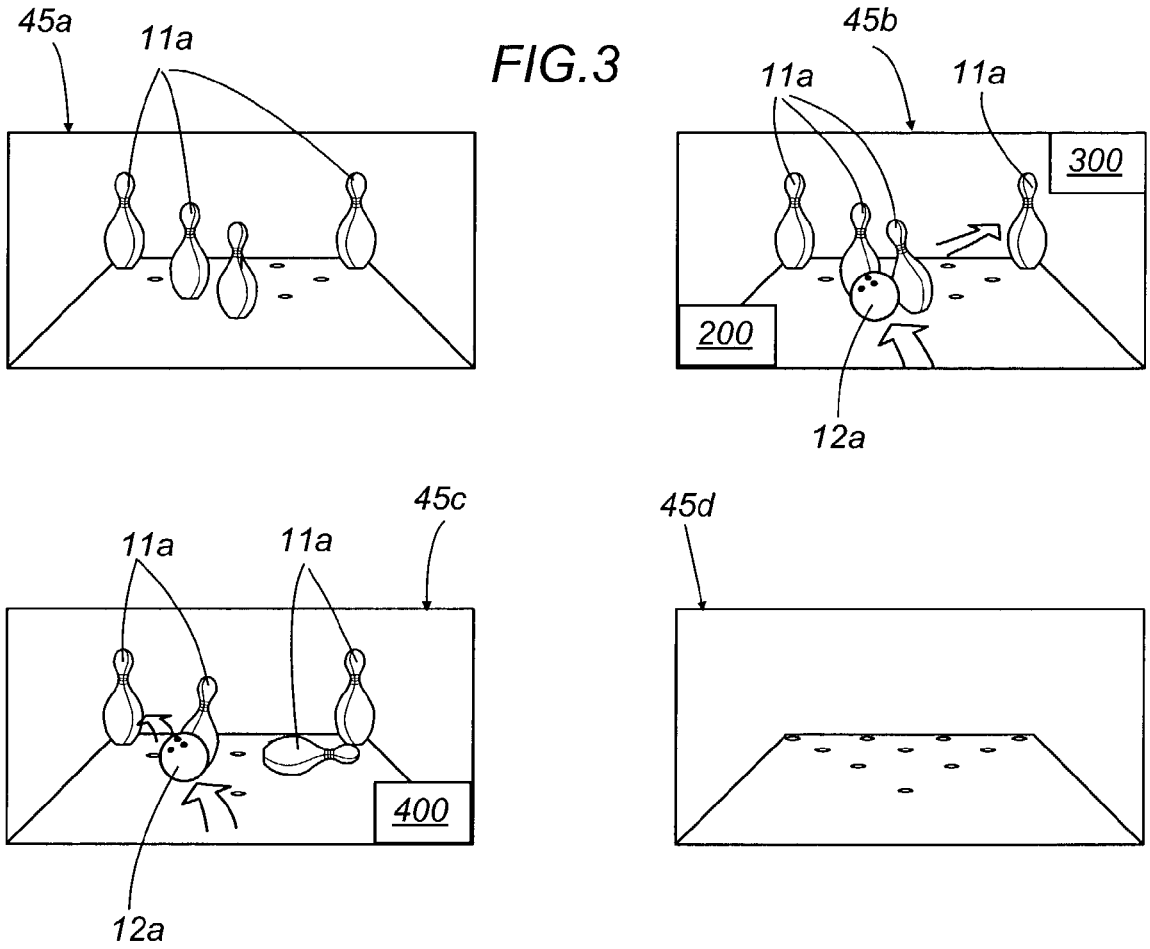
FIG. 3 is a succession of images displayed using the device illustrated in FIG. 1.

For example, FIG. 3 shows a possible sequence of an animation 45 consisting of three portions.

The first portion starts with the initial image 45*a*, showing the arrangement pattern of the pins 11*a*. By means of the next animation, the first portion represents the movement of the ball 12*a* until it hits the pins 11*a*.

At the moment of impact between the ball 12*a* and the pins 11*a*, the first portion ends and the animation stops on a first static image 45*b*, showing the directions in which the ball 12*a* is moving and the direction in which the front pin falls.

In particular, the arrow associated with the ball 12*a* is accompanied by the written message 200 "hit the 1 pin on the left", whilst the arrow relative to the pin falling is associated with the written message 300 "pin 1 is driven into the 10 pin".

After a pause of around one second, the second portion is started, showing the front pin falling (and taking the last back, right-hand pin with it), together with the second stretch over which the ball 12*a* travels.

When the ball hits the second front pin, the animation stops again, providing a static image 45*c* in which a pair of arrows indicates the change in the direction of the ball 12*a* movement and shows how the ball can, finally, hit the last back, left-hand pin.

The written explanation 400 "then ball hits the pin 2 and deflects into the pin 7" is displayed at the same time as the arrows.

The third and last portion is then activated, animating the movement seen in the previous static image 45*c*, dynamically illustrating the last stretch travelled by the ball 12*a* and the consequent fall of the last pin remaining.

The image 45*d* illustrates the end of the third portion. All of the pins 11*a* have been knocked down and the lane is empty.

It is important to emphasise how the static images which separate the different portions of an animation 45 can provide details relative to the previous portion, the next portion, or both.

Moreover, it should be noticed how the possibility of using static images to separate the dynamic portions of the animations 45 is optional and, if unwanted, can be switched off. For this reason, the device 1 has a control unit 60 (FIG. 1), connected to the control unit 40, with which each player can decide whether or not to use the additional suggestions described above.

The control unit 60 may be positioned, as illustrated in FIG. 1, close to the lane 10 so that it can be used directly by the players or, alternatively, at a remote station, not illustrated, where it is operated only by authorised personnel.

It is important to stress how, using the control unit 60, it is possible to switch on and off the option for displaying the written messages which may accompany each animation 45.

Figure 2:
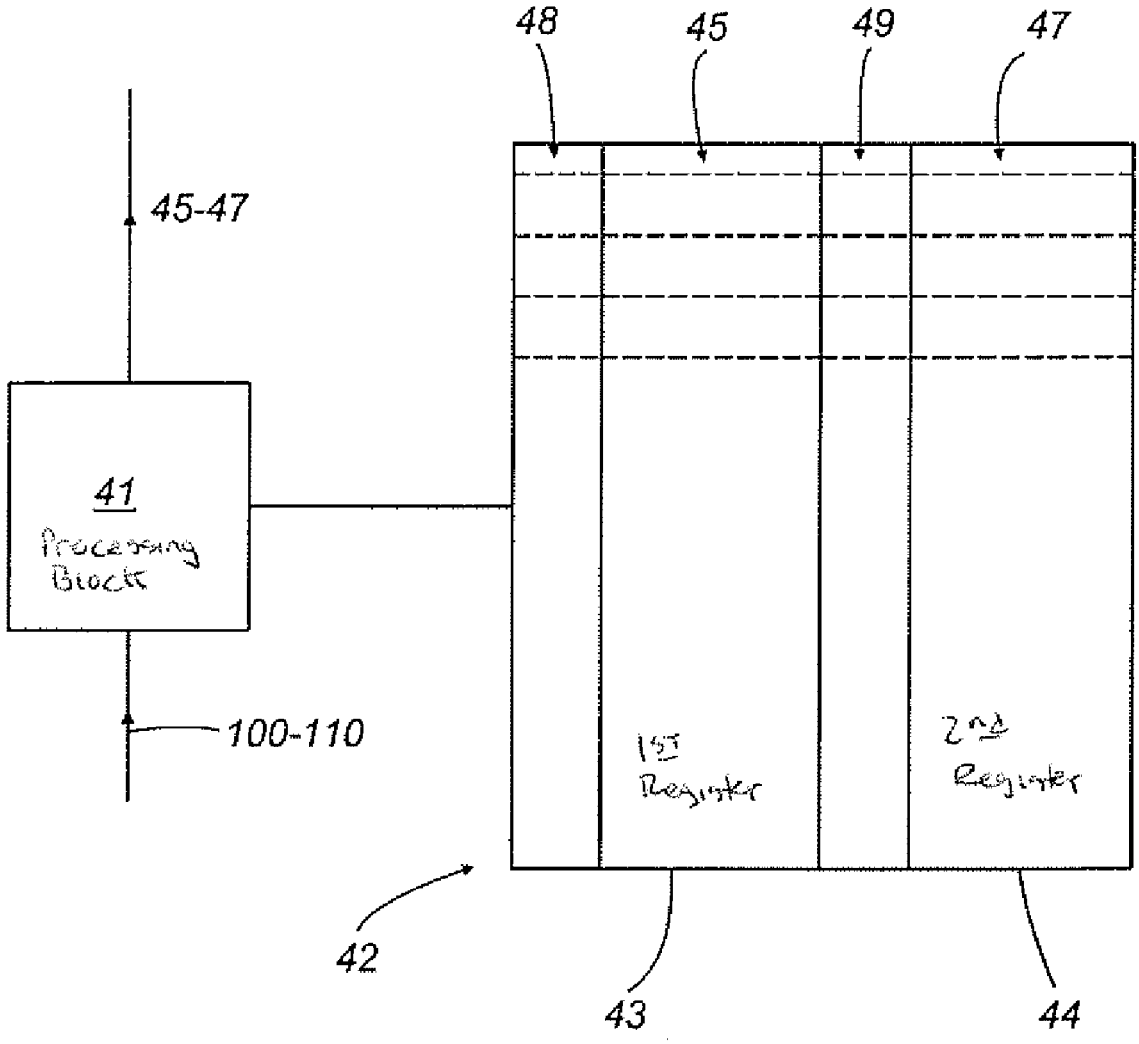
FIG. 2 is a schematic view of the logic structure of a control unit for the device in accordance with the present invention.

To select the animation 45 to be supplied at output, according to the situation created, the control unit 40 (FIG. 2) has a memory 42, with a first register 43 in which a plurality of animations 45 are stored. In the first register 43, a reference code 48 is associated with each animation 45, representing the arrangement pattern of the pins 11 for the throw illustrated in the animation 45.

In practice, the reference code 48 identifies a particular arrangement pattern of the pins 11 which are still standing after a first throw by the player. The animation 45 associated with that reference code in the first register 43 in the memory 42 must illustrate the "ideal" second throw for that pin 11 arrangement pattern. That is to say, the second throw which the player should take in that specific situation in order to complete his or her turn in the best possible way.

Linked to the memory 42 and the above-mentioned first detector means 30, is a processing block 41, which may consist of a microprocessor, which can, on each occasion, select the animation 45 most suited to the specific situation.

In particular, the processing block 41 is designed to receive the main detection signal 110 and compare the identification code 111 in it with the reference codes 48 stored in the first register 43 in the memory 42. If there is a substantial match between the identification code 111 received and a preset reference code 48 (that is to say, if the arrangement pattern of the pins 11 still standing on the bowling surface 10*a* is recognised), the processing block 41 transmits the animation 45 associated with the reference code 48 at output.

To allow the players to view the animations 45, together with all of the other information relating to the current game, the device 1 comprises a display element 50, designed to receive the data from the processing block 41, including the animations 45 selected, and to display them.

Advantageously, the display element 50 may be a conventional screen, if necessary linked to other, similar monitors, controlled by the same processing block 41 or by other smart units able to generate similar commands.

It is important to emphasise how the number of possible pin arrangement patterns, after a first throw, is very high. In particular, if you consider a total number of pins amounting to 10, the possible distributions after a player's first throw are $2^{10}=1024$.

In other words, following the first throw, there may be more than 1000 different scenarios on the bowling surface 10*a*, which must be dealt with by the player. Obviously, the creation and storing of an animation 45 for each of the possible cases would require significant resources in terms of time for the authorised operators and capacity for the device 1 memory 42.

Therefore, advantageously an animation 45 of the above-mentioned type is only created and stored for the most probable pin arrangement patterns, that is to say, those with a greater probability of occurring for the player.

According to studies carried out by operators in the sector, there are around 300 most probable pin arrangement patterns. Obviously, this kind of data may be essential for simplifying production of the device 1 disclosed. In a preferred embodiment the memory 42 contains, in the first register 43, a plurality of animations 45, each relating to a situation which may be considered "probable". To handle all of the other situations, the memory 42 has a second register 44, in which a plurality of static images 47 is stored, each relating to an "improbable" or "rare" situation.

In this way, in most cases (that is to say, for probable arrangement patterns) the player can view an animation 45, which dynamically shows them the ideal trajectory for the ball 12 and the relative consequences on the pins 11. In other cases (that is to say, for rare arrangement patterns), the display element 50 can provide the player with a static image 47, which can still provide some useful indications on how to proceed with the next throw, for example by means of written messages and/or arrows indicating the directions of movement of the various elements.

However, it is obvious that studies on the arrangement patterns of the pins 11 are carried out in such a way as to minimise the probability of the latter.

In order to select the appropriate static image 47, when necessary, in the second register 44 of the memory 42, each static image 47 is associated with a respective auxiliary reference code 49. This represents an auxiliary pin 11 arrangement pattern, that is to say, an arrangement pattern which is considered improbable following a generic throw of the ball 12. The information in the static image 47 refers to the correct completion of the second throw, according to the auxiliary arrangement pattern identified by the auxiliary reference code 49.

Each time the control unit 40 receives a main detection signal 110, as indicated above, the processing block 41 begins a series of comparisons between the identification code 111 and the reference codes 48, stored in the first register of the memory 42 and associated with the animations 45.

The case in which the identification code 111 is a substantial match with a reference code 48 (i.e.: the pin 11 arrangement pattern is a probable arrangement pattern) is examined in detail above.

Vice versa, if the identification code 111 is not a substantial match with any of the reference codes 48 (i.e.: if the pin 11 arrangement pattern is rare), the processing block 41 then compares the identification code 111 with the auxiliary reference codes 49 in the second register 44 of the memory 42.

Once a substantial match is identified between the identification code 111 and a preset auxiliary reference code 49, the processing block 41 sends the display element 50 the static image 47 associated with the above-mentioned preset auxiliary reference code 49, selected using the comparison operation described above.

Obviously, the succession of comparisons described here is given by way of example only, without limiting correct operation of the device 1. By inverting the procedure, that is to say, comparing the identification code 111 first with the auxiliary reference codes 49 and then, if necessary, with the reference codes 48, the results obtained are just the same.

Conveniently, the device 1 also has second detector means 20, connected to the control unit 40 and, in particular, to the processing block 41.

The second detector means 20 are designed to detect the passage of the ball 12 at a preset position on the bowling surface 10*a*, preferably close to the pins 11, or close to the second end 10*c* of the bowling surface 10*a*.

When the second detector means 20 detect that the ball 12 has passed the preset position, they generate an auxiliary detection signal 100, sent to the processing block 41, so that the latter can activate the first detection means 30 and proceed with the identification of the particular pin 11 arrangement pattern.

The auxiliary detection signal 100 is sent to the processing block 41 by means of the electronic card 32, connected to the second detector means 20. Therefore, the electronic card 32 is a "smart" interface between the camera 31, the second detector means 20 and the control unit 40.

It is important to emphasise that the first detector means 30 do not need to remain active during the game. They are only required when a player has taken a throw and the device 1 must count the scores and, if necessary, display an animation 45 or a static image 47 for the next throw.

Therefore, the second detector means 20, being able to detect the passage of the ball 12 close to the pins 11, are very useful for activating the first detector means 30 at the correct moment and for preventing their continued operation when they are not required.

Basically, the second detector means 20 comprise a photocell, positioned on one side of the bowling surface 10*a* and facing a reference element, mounted on the opposite side of the surface 10*a*. This detection system is of the known type and, therefore, is not described in any more detail.

Figure 5:
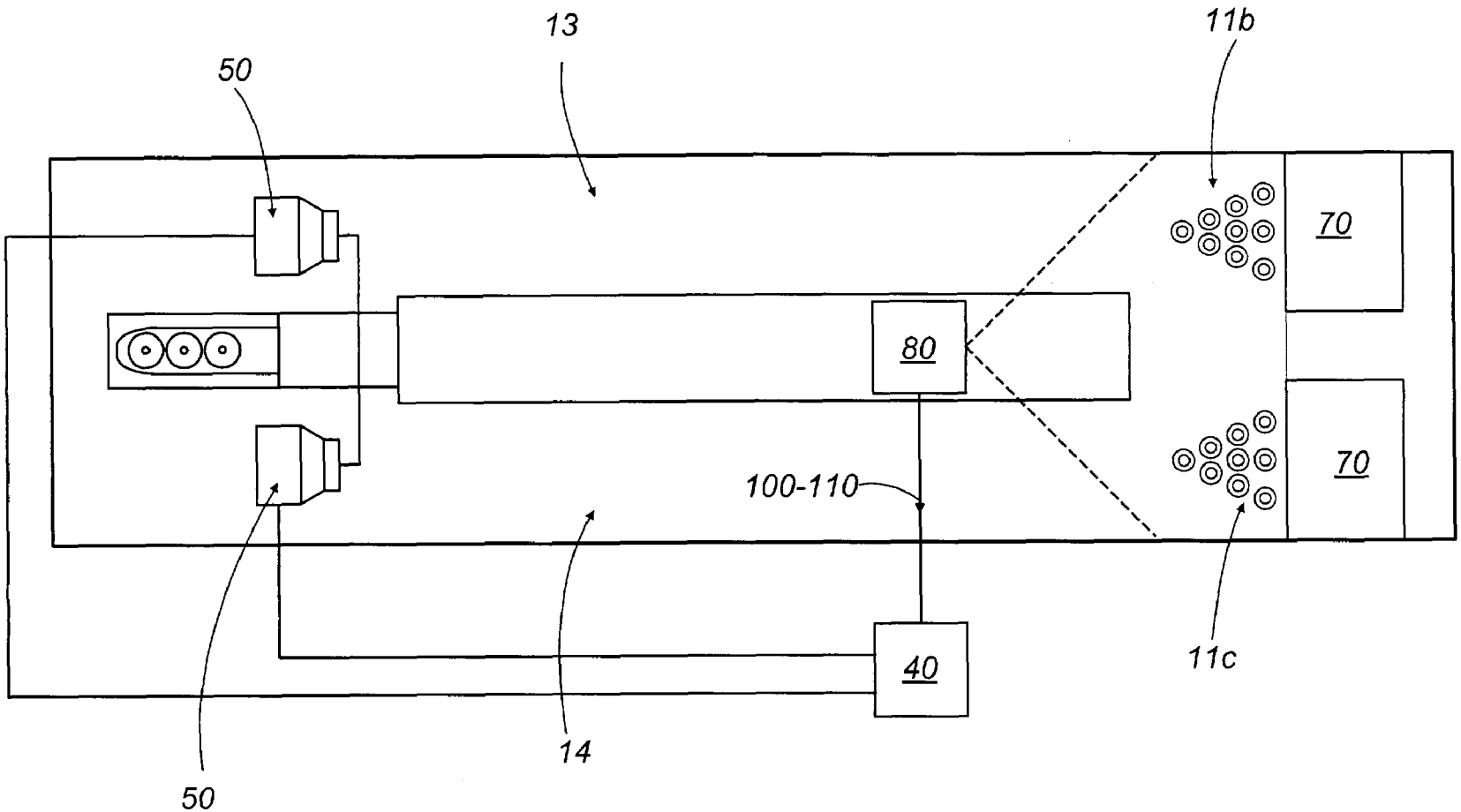
FIG. 5 is a schematic view of the device illustrated in FIG. 1 associated to an alternative embodiment of an apparatus for tenpin bowling.

In a preferred embodiment (FIG. 5), the apparatus for tenpin bowling 2 comprises at least a first lane 13 and a second lane 14 with adjacent longer sides. In this case, the first detector means 30 and the second detector means 20 can be included in a single body 80 positioned between the bowling surfaces of the two lanes 13, 14.

In other words, the photocell device of the second detector means 20, the camera 31 and, preferably, the electronic card 32 can form a single apparatus, that is to say, the single body 80, for detecting the passage of the ball 12 and the arrangement pattern of the pins 11 after the throw.

Advantageously, the single body 80 can be mounted on a channel or channel cover formed by and included in the two connected lanes 13, 14. In this particular case, the camera 31 of the first detector means 30 has an angle of vision covering the two sets of pins 11*b*, 11*c* on both lanes 13, 14.

To summarise, the procedure performed by the device 1 disclosed is as follows.

Firstly, the second detector means 20 described above detect the passage of the ball 12 at a preset position close to the pins 11. That is to say, the fact that the player has thrown the ball is detected. As a result, an auxiliary detection signal 100 is generated, necessary for activation of the subsequent stages.

The auxiliary detection signal 100 is sent to the control unit 40 by the electronic card 32.

The latter cause the first detector means 30 to detect the arrangement pattern of the pins 11, and a main detection signal 110 is generated, in accordance with said arrangement pattern. In particular, the main detection signal 110 contains an identification code 111, unambiguously associated with the pin 11 arrangement pattern detected.

The main detection signal 110 is received by the control unit 40, which in turn transmits one or more items of information at output, according to the identification code 111 received.

Specifically, the identification code 111 is compared with a preset number of programmed reference codes 48, each representing a "probable" pin 11 arrangement pattern and each associated with one of the above-mentioned animations 45. If a substantial match is identified between the identification code 111 and a preset reference code 48, the control unit 40 transmits the animation 45 associated with the selected reference code 48.

If there is no substantial match between the identification code 111 and any of the reference codes 48, a second series of comparisons is made, in particular with a preset number of auxiliary reference codes 49, each representing a "rare" pin 11 arrangement pattern and each associated with a static image 47.

When a substantial match is identified between the identification code 111 and a preset auxiliary reference code 49, the control unit 40 transmits a static image 47 associated with the selected preset auxiliary reference code 49.

Finally, the animation 45 or static image 47 transmitted by the control unit 40 are received and displayed by the display element 50.

As described above, each animation 45 may contain information on how to take the next throw and, in particular, may be an animation of the ball 12 movement and subsequent pin 11 falling movement.

Conveniently, each animation 45 may consist of a preset number of animated portions, separated by static images, which allow graphic indications, for example using arrows and written explanations, of what happens as a result of a throw correctly taken in accordance with the suggestions provided.

The present invention has important advantages.

Firstly, it allows the player(s) to be provided with complete, precise indications, so that the throw can be taken in the best possible way, maximising the probability of knocking down all of the pins on the lane.

Moreover, thanks to the animations, the player is able to achieve a full understanding of how the game works and the dynamics which can be created between the ball and pins, as well as between the various pins when they fall against one another, thus improving the player's technique.

The invention claimed is:

1. A device for displaying information, in particular for bowling alleys, comprising:

first detector means for detecting an arrangement pattern of one or more pins and generating a main detection signal, the main detection signal incorporating an identification code which represents the pin arrangement pattern;

a control unit, connected to the first detector means, which receives the main detection signal at input, and transmits, at output, at least one item of information according to the pin arrangement pattern represented by the identification code incorporated in the main detection signal; and a display element, connected to the control unit, which receives the information at input and allows it to be displayed, wherein according to the pin arrangement pattern represented by the identification code incorporated in the main detection signal, the control unit transmits an animation, containing indications on how to throw the ball in order to knock down the pins, and the display element receives and displays the animation.

2. The device according to claim 1, wherein the animation is an animated representation of the movement of the ball if thrown as indicated.

3. The device according to claim 1, wherein the first detector means are also designed to detect an arrangement pattern of one or more pins still standing after the first throw of the ball, the animation containing instructions on how to take a second throw of the ball, after the first, and, in particular, an animation of the movement of the ball according to the second throw and the falling movement of the pins as a result of the second throw.

4. The device according to claim 1, wherein the animation comprises a first portion and at least a second portion, which appears after the first, the first and second portions being separated by a static image, indicating a direction of movement of the ball and/or a direction of movement of one or more pins as the predicted result of a movement shown in the first portion, the static image comprising in particular one or more written messages, representing the movement of the ball and/or the pins.

5. The device according to claim 1, wherein the control unit comprises:

a memory, with at least a first register storing one or more animations, each associated with a reference code representing a pin arrangement pattern;

a processing block, connected to the memory, to the first detector means and to the display element, and designed to:

receive the main detection signal;

compare the identification code incorporated in the main detection signal with the reference codes stored in the first register of the memory;

find a substantial match between the identification code and a programmed reference code; and send an animation associated with the preset reference code to the display element.

6. The device according to claim 1, further comprising second detector means, designed to detect the passage of the ball at a preset position, close to the pins and generate at output an auxiliary detection signal, sending the signal to the control unit to activate at least the first detector means.

7. The device according to claim 1, wherein the animation is an animated representation of the falling movement of the pins as a result of the throw.

8. The device according to claim 1, wherein the control unit and the display element cooperate to:

display a first portion of the animation, pause the animation on a static image for a preset interval, and display a second portion of the animation.

9. The device according to claim 4, wherein the animation comprises a plurality of portions, which succeed one another, each separated from an immediately previous portion by a static image, indicating a direction of movement of the ball and/or a direction of movement of one or more pins, as predicted following a movement illustrated in the immediately previous portion, each of the static images having one or more written messages, representing the movement of the ball and/or the pins.

10. The device according to claim 5, wherein the memory also comprises a second register storing one or more static images, each associated with an auxiliary reference code representing an auxiliary pin arrangement pattern, the processing block also being able to:

compare the identification code incorporated in the main detection signal with the auxiliary reference codes stored in the second register of the memory;

find a substantial match between the identification code and a programmed auxiliary reference code; and send a static image associated with that programmed auxiliary reference code to the display element, the display element also being designed to receive and display the static image, each of the static images having one or more written messages, indicating the movement of the ball and/or the pins.

11. An apparatus for tenpin bowling, comprising:

a preset number of lanes, each having a bowling surface which extends mainly longitudinally, with a first end, for throwing the ball, and a second end for the arrival of the ball, a preset number of pins being set out at the second end; and a collection device, positioned at the second end of the bowling surface, for collecting and arranging the pins on the bowling surface; the apparatus being characterised in that it also comprises a device for displaying information in accordance with any of the claims from 1 to 6.

12. The apparatus according to claim 11, wherein at least a first lane and a second lane, adjacent to the first lane, the first detector means and the second detector means being included in a single body, positioned between the bowling surfaces of the first and second lanes.

13. A procedure for displaying information, in particular for bowling alleys, comprising the following steps:

detecting an arrangement pattern of one or more pins;

generating a main detection signal, incorporating an identification code which represents the pin arrangement pattern;

receiving the main detection signal;

transmitting at least one item of information according to the arrangement pattern of the pins indicated by the identification code incorporated in the main detection signal; and displaying the information, wherein the step of transmitting the information comprises a further step of transmitting an animation, the animation containing indications on how to throw the ball in such a way as to knock down the pins.

14. The procedure according to claim 13, wherein the animation is an animated representation of the movement of the ball according to the throw and the falling movement of the pins predicted as a result of the throw.

15. The procedure according to claim 13, wherein the step of detecting the arrangement pattern of one or more pins is carried out after a first throw of the ball so as to detect the arrangement pattern of the pins still standing, the animation containing instructions on how to take a second throw of the ball, after the first, and in particular, an animation of the movement of the ball according to the second throw and the falling movement of the pins predicted as a result of the second throw.

16. The procedure according to claim 13, wherein the animation comprises a first portion and at least a second portion, which appears after the first, the first and second portions being separated by a static image, indicating a direction of movement of the ball and/or a direction of movement of one or more of the pins predicted as a result of a movement represented in the first portion, the static image including one or more written messages indicating the movement of the ball and/or the pins.

17. The procedure according to claim 13, wherein the animation transmission step comprises the following further steps:

comparing the identification code incorporated in the main detection signal with a preset number of programmed reference codes;

finding a substantial match between the identification code and a programmed reference code; and sending, at output, an animation associated with the programmed reference code.

18. The procedure according to claim 13, wherein the information transmission step comprises the following further steps:

comparing the identification code incorporated in the main detection signal with a preset number of programmed auxiliary reference codes;

finding a substantial match between the identification code and a programmed auxiliary reference code;

sending, at output, a static image associated with the programmed auxiliary reference code and including one or more written messages indicating the movement of the ball and/or the pins.

19. The procedure according to claim 13, wherein the step of detecting the arrangement pattern of one or more pins is preceded by the following further steps:

detecting the passage of the ball at a preset position, close to the pins; and generating an auxiliary detection signal, depending on detection of the passage of the ball.

20. The procedure according to claim 16, wherein the animation comprises a plurality of portions, which succeed one another, each separated from an immediately previous portion by a static image, indicating a direction of movement of the ball and/or a direction of movement of one or more pins, as predicted following a movement illustrated in the immediately previous portion, each of the static images having one or more written messages, representing the movement of the ball and/or the pins.

* * * * *